US006648253B1

(12) United States Patent
Adolph et al.

(10) Patent No.: US 6,648,253 B1
(45) Date of Patent: Nov. 18, 2003

(54) METHOD FOR OPERATING THE AIR CIRCUIT AND CONVEYING STOCK FLOW IN THE CASING OF A HAMMER MILL

(75) Inventors: Manfred Adolph, Langenfeld (DE); Erich Kohl, Meerbusch (DE); Heike Sommerfeld, Dormagen (DE)

(73) Assignee: Metso Lindemann GmbH, Dusseldorf (DE)

( * ) Notice: Subject to any disclaimer, the term of this patent is extended or adjusted under 35 U.S.C. 154(b) by 0 days.

(21) Appl. No.: 09/762,489

(22) PCT Filed: Aug. 2, 1999

(86) PCT No.: PCT/DE99/02356

§ 371 (c)(1),
(2), (4) Date: Feb. 6, 2001

(87) PCT Pub. No.: WO00/07730

PCT Pub. Date: Feb. 17, 2000

(30) Foreign Application Priority Data

Aug. 7, 1998 (DE) ..... 198 35 796

(51) Int. Cl.[7] ..... B02C 13/286
(52) U.S. Cl. ..... 241/73; 241/88.4; 241/189.1
(58) Field of Search ..... 241/73, 88.4, 189.1

(56) References Cited

U.S. PATENT DOCUMENTS

| | | | | | |
|---|---|---|---|---|---|
| 1,751,009 | A | * | 3/1930 | Liggett | 241/185.5 |
| 4,002,462 | A | * | 1/1977 | Maddox | 209/137 |
| 4,033,458 | A | * | 7/1977 | Chazen et al. | 209/11 |
| 4,221,655 | A | * | 9/1980 | Nakayama et al. | 209/135 |
| 4,222,530 | A | | 9/1980 | Whitney | 241/194 |
| 4,542,856 | A | | 9/1985 | Adolph | 241/69 |
| 4,600,622 | A | * | 7/1986 | Carlson et al. | 428/131 |
| 4,650,129 | A | * | 3/1987 | Newell et al. | 241/185.5 |
| 4,982,904 | A | * | 1/1991 | Greiner | 241/189.1 |
| 5,044,567 | A | * | 9/1991 | Hausler et al. | 241/186.3 |
| 5,178,335 | A | * | 1/1993 | Mertens | 241/101.2 |
| 5,183,212 | A | * | 2/1993 | Boo et al. | 209/17 |
| 5,273,218 | A | * | 12/1993 | Burns | 241/189.1 |
| 5,443,568 | A | | 8/1995 | Popovich | 241/189.1 |
| 5,558,281 | A | * | 9/1996 | Bouldin et al. | 241/189.1 |
| 5,950,940 | A | * | 9/1999 | Hoof et al. | 241/189.1 |
| 6,102,311 | A | * | 8/2000 | Fujikawa | 241/189.1 |

FOREIGN PATENT DOCUMENTS

| | | | |
|---|---|---|---|
| DE | 43 43 801 A1 | 6/1995 | |
| EP | 0 103 240 | 3/1984 | B02C/13/282 |
| EP | 0 368 759 | 5/1990 | |
| FR | 2 598 099 | 11/1987 | |
| GB | 2 143 748 A | 2/1985 | |
| JP | 0 708 0334 | 3/1995 | B02C/13/288 |

OTHER PUBLICATIONS

Japanese Patent Abstract vol. 096, No. 001, Jan. 31, 1996 & JP 07 241485 A (Fuji Kogyo KK).

* cited by examiner

*Primary Examiner*—William Hong
(74) *Attorney, Agent, or Firm*—Norris McLaughlin & Marcus, P.A.

(57) ABSTRACT

To operate the air circulation and convey the stock flow of scrap material comminuted in the housing (1) of a hammer mill, the airflow generated by the blower effect of a rotor (2) and the stock flow passing through an upper classifying grate (4) are diverted by a deflector hood (8) and guided vertically downwards into a duct (6) that is separate from the housing (1). The stock flow is combined with the stock flow classified in the area of a lower classifying grate (5). The air flow is then guided in the circulating air and the combined stock flow is conveyed to a device (11) for further processing, sorting and/or conveyance.

14 Claims, 2 Drawing Sheets

1
3
8
4
6
2
7
5
11

9
8
6
1
4
13
2
3
7
5
11
12
10

METHOD FOR OPERATING THE AIR CIRCUIT AND CONVEYING STOCK FLOW IN THE CASING OF A HAMMER MILL

BACKGROUND OF THE INVENTION

The invention relates to a method for operating the air circulation and conveying stock flow in the housing of a hammer mill which preferably comminutes old material. The invention further relates to a housing of the hammer mill for carrying out the method.

DESCRIPTION OF THE RELATED ART

It is generally known that hammer mills can be used for comminuting scrap metal, such as auto bodies, so-called white goods, as well as electronic scrap material and the like.

Hammer mills of this type consist essentially of a housing with a stock inlet, an upper and a lower classifying grate, a rotor rotatably which is supported in the housing and provided with tools, such as hammers, and which is driven with a relatively a high circumferential velocity. The rotor rotating in the housing, however, causes the hammer mill to have attributes of a radial blower that are undesirable in practice. The hammers in this case act as blades which draw in the ambient air through a portion of the grate openings in the lower classifying grate and blow out the air through the grate openings in the upper classifying grate.

This effect causes an overpressure inside the housing, which tries to equalize with the atmospheric pressure. Depending on the composition of a stock to be comminuted, this can generate significant quantities of dust and adversely affect the environment in the vicinity of the hammer mill.

As described in U.S. Pat. No. 4,542,856, it has been observed in hammer mills connected with dust exhaust devices that the blower effect of the hammer rotor has a much greater effect on the size and the air capacity of the dust exhaust device than the actual quantity of dust to be removed.

To optimize the oversized dust exhaust devices, which consume a large amount of energy and are also very noisy and expensive to built, it was suggested in U.S. Pat. No. 4,542,856 A1 to reduce the disadvantageous blower effect of the hammer rotor by subdividing the housing into at least two chambers which are arranged a series in the rotation direction of the rotor. Although this solution appeared to be effective, it was not successful in practical applications, because it was recognized that it is essentially impossible to eliminate the aforedescribed blower effect, leaving little choice but to continue using the expensive, oversized and environmentally harmful dust exhaust devices.

SUMMARY OF THE INVENTION

It is therefore an object of the invention to take advantage of the intrinsically disadvantageous blower effect for operating the hammer mill, to design the housng accordance the complexity of the required dust exhaust devices.

According to the method of the invention, the object is solved in that the air flow and the stock flow, after having passed the upper classifying grate, is diverted by a deflector hood and a subsequent duct downwardly in an essentially vertical direction and offset as well as separated from the housing wall to the region of the lower classifying grate. The existing underpressure causes the air fraction to be again drawn into the comminution chamber after passing the lower classifying grate, thereby establishing a continuous recirculating air flow with an approximately constant air volume.

If a dust exhaust device is connected, the air capacity of the dust exhaust device can be reduced by the fraction of the air that is already circulating.

Advantageously, the connection for the dust exhaust air can be moved to the end of the channel and to the region of the lower classifying grate, respectively, to improve the sorting effect for removing the comminuted light stock, for example upholstery materials (light shredder fraction), from the comminuted heavy stock, for example comminuted metal pieces, such as old car bodies, that are conveyed from the hammer mill through the stock inlet.

The sorting effect can be improved by providing the device, which is located in the region of the lower classifying grate and intended for further processing, sorting and/or conveying of the comminuted old material, with a stage/cascade, into which an additional blower having a lower power blows in air. In this way, the lighter components, for example the so-called light shredder fraction, can be separated from the metal fraction more precisely before being conveyed to the dust exhaust duct.

An additional effect can be achieved by adding during the comminution process finely atomized or nebulized water to the circulating air flow and/or into the housing, whereby the water molecules and/or the large surface area of the water particles extract a significant amount of heat from the supplied old material, for example the car bodies, during the comminution process. This also reduces the danger of an explosion and fire as well as the creation of burnt hydrocarbons or so-called "blue smoke", which is frequently generated by residual fuel or drawing compounds that remain in the old material.

Nebulized water is preferably injected into the housing above the rotor through tubes. The quantity of nebulized water per unit time can be controllably supplied as a function of the quantity of material in the comminution chamber by measuring the electric current drawn by the drive motor that drives the rotor or by measuring the temperature difference between the internally circulating air and the ambient air.

The housing of the hammer mill is connected with a dust exhaust device. The dust exhaust air volume is reduced by a fraction of the air volume produced by the blower effect of the rotor, and is added in a region of a lower classifying grate and removed together with portions of a comminuted fraction to the dust exhaust device through a dust exhaust duct which is separate from the duct. A portion of the admitted dust exhaust air together with fine particles of the scrap material is removed to the dust exhaust device in the region of the stock inlet. The stock flow that is combined in the region of the lower classifying grate is supplied with additional air through a blower via a cascade , whereby light fraction components of the comminuted scrap material are conveyed through the dust exhaust duct to the dust exhaust device. During the comminution process finely atomized or nebulized water is supplied to the circulating air flow and/or the housing or the comminution chamber, whereby heat is removed from the supplied scrap material by the water molecules during the comminution and/or the danger risk of an explosion or fire as well as the formation of burnt hydrocarbons is at least reduced. The finely atomized or nebulized water with the dimension quantity vs. unit time is added and regulated as a function of the quantity of material in the comminution chamber by measuring the electric current drawn by the drive motor that drives the rotor or by measuring the temperature difference between the internally circulating air and the surrounding air.

An upper classifying grate is used, wherein a plane of the grate is inclined relative to the rear wall of the housing, and wherein the stock flow is guided between grate bars that are oriented perpendicular to the inclined grate plane. An upper classifying grate is used, with a plane of the grate being oriented perpendicular relative to the rear wall of the housing or horizontally, and wherein the stock flow is guided between grate bars that are inclined with respect to the horizontal. A pivotable upper classifying grate may be used. Also, a controller for conveying the stock flows is used to which the circulating air or dust exhaust air is applied, depending on the composition of the old material, the composition and type of the comminuted material, as well as the quantity, power and/or pressure of the circulating air or dust exhaust air to be produced.

The housing of a hammer mill for carrying out the method, includes a rotor which is rotatably supported in a housing and provided with tools, a stock inlet, a stock outlet provided in the upper housing with an upper classifying grate and a stock outlet provided in the lower housing with a lower classifying grate. The housing has a deflection hood following the upper classifying grate, followed by a duct leading to the region of the lower classifying grate. A dust exhaust duct is provided which extends parallel to the duct to a dust exhaust device. The dust exhaust duct is located after the duct in the region of the lower classifying grate and deflects a portion of the air flow and conveys portions of a comminuted fraction with the dust exhaust air. The region performing the deflection from the duct to the dust exhaust duct as well as at least a portion of the region of the lower classifying grate are implemented as a device for further sorting of the comminuted old material. A blower is associated with the device, the blower in conjunction with a stage/cascade disposed in the flow of the device representing a sorter for effectively separating the light fraction components of the comminuted scrap material and conveying the light fraction components via the dust exhaust duct to the dust exhaust device. A swing-out door is provided. The upper classifying grate is inclined as it covers the upper stock outlet, wherein the grate rods, as viewed in cross-section, are oriented perpendicular to the inclination plane. The upper classifying grate is horizontal as it covers the upper stock outlet, wherein the grate rods, as viewed in cross-section, are inclined relative to the horizontal. A pivotable upper classifying grate which at the same time represents a counter-tool for the tools of the rotor as well as a swing-out door.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWING

The invention is described with reference to two exemplary embodiments illustrated in the drawings.

DETAILED DESCRIPTION OF THE PRESENTLY PREFERRED EMBODIMENTS

Figure 1:
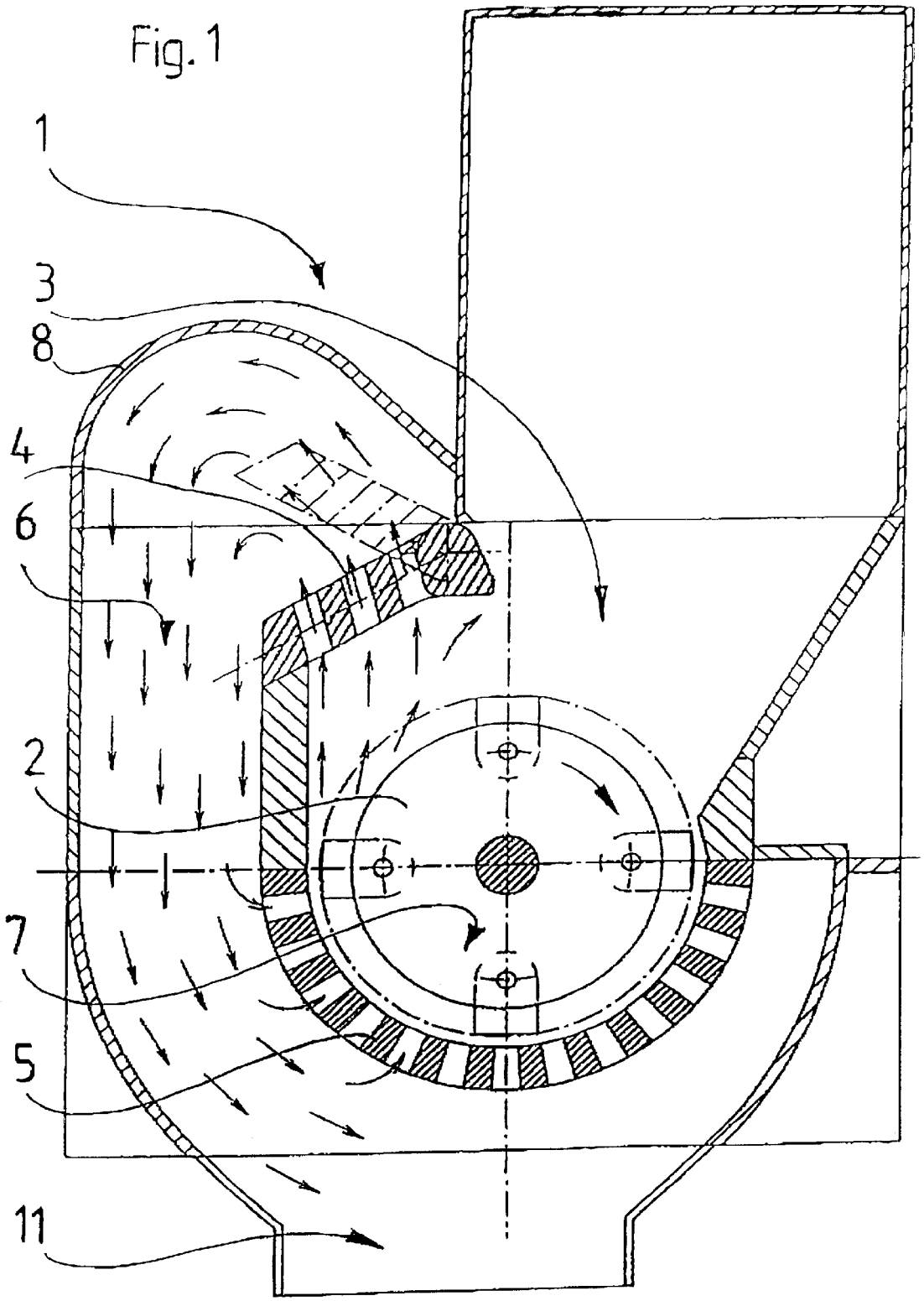
FIG. 1 is a cross-section through a housing according to the invention of a hammer mill without a connection for a dust exhaust device.
Figure 2:
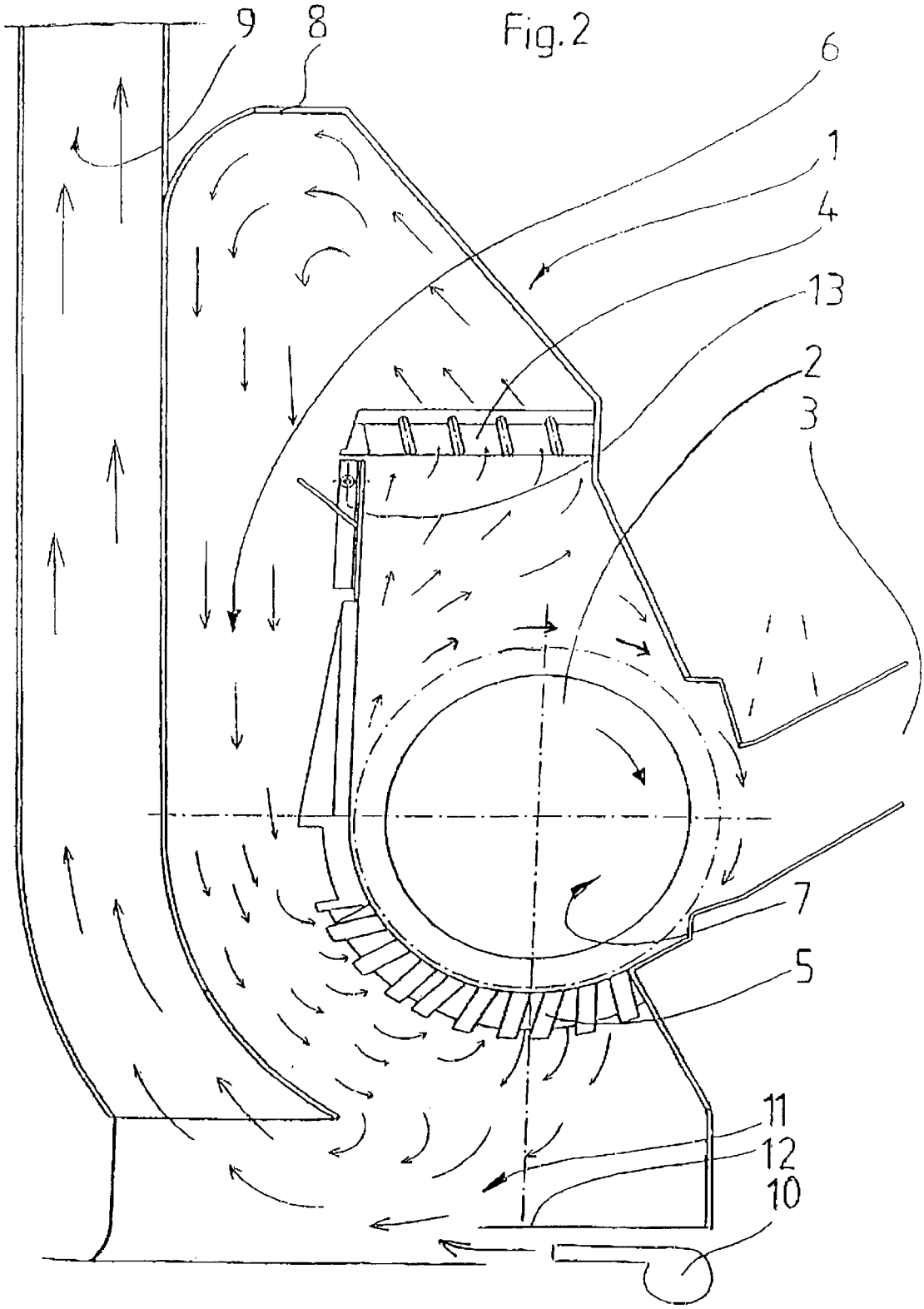
FIG. 2 is a cross-section through a housing according to the invention of a hammer mill with a dust exhaust duct leading to a dust exhaust device (not shown).

As illustrated in FIGS. 1 and 2, a hammer mill includes a housing 1 with a stock inlet 3, a stock outlet with an upper classifying grate 4, a stock outlet with a lower classifying grate 5 as well as a rotor 2 which is rotatably supported in the housing 1 and provided with tools. The rotor is driven with a relatively high circumferential velocity and comminutes the old material, for example scrap metal, car bodies, so-called white goods as well as electronic scrap material, supplied to a comminution chamber 7 above the stock inlet 3 by a process where the tools disposed on the rotor, such as hammers, cooperate with a stationary tool disposed on the housing 1, such as an anvil located on the upper classifying grate 4 (FIG. 1).

The tools disposed on the rotor 2 that rotates in the housing 1 act as blades and produce an air current similar to a blower, wherein the air current is drawn in from the ambient air through the openings of the lower classifying grate 5 and blown out through the openings of the upper classifying grate 4. At the same time, a classified stock flow passing through the upper classifying grate 4 and a classified stock flow passing through the lower classifying grate 5 are produced. The air flow and the stock flows are indicated schematically in the drawings by arrows without a reference numeral.

As described above, the consensus until now was that the blower effect of the rotor 2 must be eliminated and/or at least reduced by subdividing the housing 1 and by drawing off the dust exhaust air at the respective classifying grates 4, 5.

Surprisingly, however, the invention employs the blower effect which has previously been viewed as undesirable, to its advantage by effectively using the air current as a recirculating air flow and deflecting the air current together with the classified stock flow of the comminuted scrap material that passes through the upper classifying grate 4 with the help of a deflector hood 8 that has not been used before, and by guiding the deflected flow vertically downwardly in a duct 6 which is separated from the housing 1, by combining this stock flow in the region of the lower classifying grate 5 with the stock flow of the comminuted scrap material classified in the grate 5, and by, on one hand, repeatedly recirculating the air flow produced by the underpressure in the loop "lower classifying grate 5—comminution chamber 7—upper classifying grate 4—duct 6" and by, on the other hand, conveying the combined stock flow of the comminuted scrap material to a device 11 for further processing, sorting and/or conveyance.

In special cases, it may be necessary to add a dust exhaust device to the housing 1, as illustrated in FIG. 2, in particulars when an overpressure is present in the housing 1 and/or the so-called light shredder fraction has to be separate more efficiently from the heavy fraction (e.g., iron (Fe)). For this purpose, a dust exhaust air volume which is reduced by the fraction of the air volume produced by the blower effect of rotor 2, is added in a region of the lower classifying grate 5 and conveyed together with portions of a comminuted fraction, in this case the light shredder fraction, to the dust exhaust device through a dust exhaust duct 9 which runs parallel to the duct 6. A portion of the applied dust exhaust air can also be used to convey to the dust exhaust device the dust that is produced by the fine particles of the supplied scrap material in the region of the stock inlet 3, as indicated schematically in FIG. 2.

The light fraction can be separated particularly efficiently by using a blower 10 and a cascaded stage 12 to supply additional air to the stock flow that is combined in the region of the lower classifying grate 5.

In summary, the invention provides a technically less complex hammer mill that operates more efficiently and is environmentally friendly.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A method for operating air circulation and conveying stock flow in a housing (1) of a hammer mill during comminution of scrap material, comprising the steps of:

(a) continually feeding the scrap material to be comminuted through a stock inlet (3) provided in the housing (1) having an upper and a lower portion, (b) comminuting the scrap material with a rotor (2) including tools, the rotor is rotatably supported in the housing (1) and produces a blower effect with an air flow, (c) conveying the stock flow of the comminuted scrap material through a stock outlet in an upper classifying grate (4) provided in the upper portion of the housing (1), and conveying the stock flow of the comminuted scrap material through a stock outlet in a lower classifying grate provided in the lower portion of the housing, within an internal air circulation loop, a plane of the upper classifying grate is inclined relative to a rear wall of the housing (1), and wherein the stock flow is guided between grate bars of the upper classifying grate that are oriented substantially perpendicular to the inclined grate plane, wherein the air flow produced by the blower effect of the rotor (2) together with the classified stock flow that passes through the upper classifying grate (4) of the comminuted scrap material is diverted by a deflector hood (8) and guided downwardly in a duct (6) that is separate from the housing (1), and wherein the stock flow is combined in a region of the lower classifying grate (5) with the stock flow of the comminuted scrap material classified at the lower classifying grate (5), and wherein the air flow is repeatedly guided in a loop by underpressure in the loop between the lower classifying grate (5), the comminution chamber (7), the upper classifying. grate (4) and the duct (6), and wherein the combined stock flow of the comminuted scrap material is conveyed to a device (11) for further processing.

2. The method according to claim 1, wherein the housing is connected with a dust exhaust device, and wherein a dust exhaust air volume which is reduced by the fraction of the air volume produced by the blower effect of the rotor (2), is added in a region of the lower classifying grate (5) and removed together with portions of a comminuted fraction to the dust exhaust device through a dust exhaust duct (9) which is separate from the duct (6).

3. The method according to claim 2, wherein a portion of the dust exhaust air together with fine particles of the scrap material is removed to the dust exhaust device in the region of the stock inlet (3).

4. The method according to one of the claims 1, wherein the stock flow that is combined in the region of the lower classifying grate (5) is supplied with additional air through a blower (10) via a cascade (12), whereby light fraction components of the commninuted scrap material are conveyed through the dust exhaust duct (9) to the dust exhaust device.

5. The method according to claim 1, further comprising the step of using an upper classifying grate (4), wherein a plane of the grate is oriented perpendicular relative to the rear wall of the housing (1), and wherein the stock flow is guided between grate bars that are inclined.

6. The method according to claim 1, wherein the upper classifying grate (4) is pivotable.

7. A housing of a hammer mill having an upper housing and a lower housing the housing including a rotor which is rotatably supported in a housing and provided with a plurality of tools, a stock inlet (3), a stock outlet provided in the upper housing with an upper classifying grate (4) and a stock outlet provided in the lower housing with a lower classifying grate (5), wherein the housing (1) has a deflection hood (8) following the upper classifying grate (4), followed by a duct (6) leading to the region of the lower classifying grate (5), the upper classifying grate (4) is inclined when in a position covering the upper stock outlet, wherein grate rods of the upper classifying grate, as viewed in cross-section, are oriented substantially perpendicular to the inclination plane and wherein stock flow is combined in a region of the lower classifying grate (5) with stock flow of comminuted scrap material classified at the lower classifying grate (5), and wherein air flow produced by the rotor is repeatedly guided in a loop by underpressure in the loop between the lower classifying grate (5), the comminution chamber (7), the upper classifying grate (4) and the duct (6).

8. The housing according to claim 7, wherein a dust exhaust duct (9) is provided which extends parallel to the duct (6) to a dust exhaust device, and wherein the dust exhaust duct (9) is located after the duct (6) in the region of the lower classifying grate (5) and deflects a portion of the air flow and conveys portions of a comminuted fraction with the dust exhaust air.

9. The housing according to claim 8, wherein the region performing the deflection from the duct (6) to the dust exhaust duct (9) as well as at least a portion of the region of the lower classifying grate (5) are implemented as a device (11) for further sorting of the comminuted old material.

10. The housing according to claim 8, wherein a blower (10) is associated with the device (11), the blower in conjunction with a stage/cascade (12) disposed in the flow of the device (11) representing a sorter for effectively separating the light fraction components of the comminuted scrap material and conveying the light fraction components via the dust exhaust duct (9) to the dust exhaust device.

11. The housing according to claim 7, further providing a swing-out door (13) between the lower classifying grate (5) and the upper classifying grate (4).

12. A hammer mill having a housing, including an upper housing and a lower housing, the housing including a rotor which is rotatably supported in a housing and provided with a plurality of tools, a stock inlet (3), a stock outlet provided in the upper housing with an upper classifying grate (4) and a stock outlet provided in the lower housing with a lower classifying grate (5), wherein the housing (1) has a deflection hood (8) following the upper classifying grate (4), followed by a duct (6) leading to the region of the lower classifying grate (5), and wherein the upper classifying grate (4) is substantially horizontal when in a position covering the upper stock outlet, and wherein the grate rods of the upper classifying grate, as viewed in cross-section, are inclined relative to the horizontal and wherein stock flow is combined in a region of the lower classifying grate (5) with stock flow of comminuted scrap material classified at the lower classifying grate (5), and wherein air flow produced by the rotor is repeatedly guided in a loop by underpressure in the loop between the lower classifying grate (5), the comminution chamber (7), the upper classifying grate (4) and the duct (6).

13. A hammer mill having a housing, including an upper housing and a lower housing, the housing including a rotor which is rotatably supported in a housing and provided with a plurality of tools, a stock inlet (3), a stock outlet provided in the upper housing with an upper classifying grate (4) and a stock outlet provided in the lower housing with a lower classifying grate (5), wherein the housing (1) has a deflection hood (8) following the upper classifying grate (4), followed by a duct (6) leading to the region of the lower classifying grate (5), and wherein a pivotable upper classifying grate (4) which at the same time represents a counter-tool for the tools of the rotor (2) as well as a swing-out door, wherein the upper classifying grate (4) is substantially horizontal when in a position covering the upper stock outlet, and wherein the grate rods of the upper classifying grate, as viewed in cross-section, are inclined relative to the horizontal and wherein stock flow is combined in a region of the lower classifying grate (5) with stock flow of comminuted scrap material classified at the lower classifying grate (5), and wherein air flow produced by the rotor is repeatedly guided in a loop by underpressure in the loop between the lower classifying grate (5), the comminution chamber (7), the upper classifying grate (4) and the duct (6).

14. A hammer mill according to claim 12, wherein the upper classifying grate (4) is pivotable, which at the same time represents a counter-tool for the tools of the rotor (2) and a swing-out door.

* * * * *